United States Patent [19]

Genthe et al.

[11] 3,991,712

[45] Nov. 16, 1976

[54] CASCADE DEVELOPMENT STATION HAVING A ROUGHENED DEVELOPMENT PLATE FOR ENHANCING DEVELOPER MIXTURE TURBULENCE

[75] Inventors: James E. Genthe, Chelmsford; William R. Buchan, Lincoln, both of Mass.

[73] Assignee: Itek Corporation, Lexington, Mass.

[22] Filed: Feb. 6, 1975

[21] Appl. No.: 547,851

Related U.S. Application Data

[63] Continuation-in-part of Ser. No. 429,616, Jan. 2, 1974, abandoned.

[52] U.S. Cl. ..... 118/637; 118/636

[51] Int. Cl.[2] ..... G03G 15/08

[58] Field of Search ..... 118/DIG. 24, 636, 637; 427/20, 21

[56] References Cited

UNITED STATES PATENTS

| | | | |
|---|---|---|---|
| 3,147,147 | 9/1964 | Carlson | 118/637 |
| 3,503,776 | 3/1970 | Gundlach | 118/637 |
| 3,633,544 | 1/1972 | Weiler | 118/637 |
| 3,638,611 | 2/1972 | Weiler et al. | 118/636 |
| 3,651,784 | 3/1972 | Hewitt | 118/637 |
| 3,685,488 | 8/1972 | Stover | 118/DIG. 24 |
| 3,921,571 | 11/1975 | Moore et al. | 118/637 |
| 3,921,578 | 11/1975 | Genthe et al. | 118/637 |

*Primary Examiner*—Mervin Stein
*Assistant Examiner*—Douglas Salser
*Attorney, Agent, or Firm*—Homer O. Blair; Robert L. Nathans; Gerald H. Glanzman

[57] ABSTRACT

A special inexpensive development electrode within a cascade development station is positioned closely adjacent to a xerographic drum to define a development zone therebetween. The electrode is roughened by producing deflection elements thereon forming a waffle-like or diamond-shaped knurled pattern projecting into the development zone, and, at the same time, is designed to be spaced from the drum by a distance which varies from between a relatively wide spacing adjacent the input end of the development zone and a relatively narrow spacing toward the output end of the zone. Together, the variable spacing of the zone and the deflection elements have the effect of increasing the density of the developer in the zone to thus decrease its velocity through the zone so that directional effects in developed images due to a high velocity differential between the developer and the drum can be controlled and substantially eliminated, while at the same time, introducing a radial component of motion to the developer toward the drum. These characteristics result in an increased number of development events, an increased quantity of toner within the development zone, more effective scavenging of toner from background portions of the drum and, in general, greater uniformity and speed in the development operation.

23 Claims, 5 Drawing Figures

CASCADE DEVELOPMENT STATION HAVING A ROUGHENED DEVELOPMENT PLATE FOR ENHANCING DEVELOPER MIXTURE TURBULENCE

This application is a continuation-in-part application of U.S. Ser. No. 429,616, filed Jan. 2, 1974, now abandoned.

BACKGROUND OF THE INVENTION

This invention relates to the field of xerographic development stations.

In spite of the fact that a tremendous amount of research has been performed in the field of the development of electrostatic images by the application of developer thereto, it is desirable to still further increase development efficiency. In ordinary commercial cascade development stations, a development mixture in the form of carrier and toner is cascaded through a development zone where it first contacts an upper drum portion and thereafter follows a trajectory such that often a large portion of the developer does not contact lower portions of the drum due to high centrifugal forces acting on the developer, and this tends to prevent effective development. Furthermore, in such systems, background toner on the drum is not adequately scavenged, and this can produce unattractive copies. Additionally, excessive buildup of toner is often produced on the development electrode. Thus, it is highly desirable to substantially reduce these undesirable effects to allow for a more efficient use of the available developer mixture and to produce cleaner copy. The attainment of increased development efficiency results in the production of a greater number of copies per minute for any given drum size, or conversely results in the employment of a smaller drum for a fixed rate of copy output. Additionally, because of the increased developer efficiency, the carrier will tend to become more depleted of toner. This condition causes a greater charge imbalance to exist on the carrier which in turn can enhance developer scavenging of the background areas to produce copy free from background toner. A straightforward inexpensive means for accomplishing these results is greatly desired.

SUMMARY OF THE INVENTION

The foregoing goals have been accomplished by virtue of the employment, in the preferred embodiment, of a development electrode which is roughened over a substantial portion of its surface, and, at the same time, is spaced from the drum by a variable distance to provide a development zone which is relatively wide adjacent the input end of the zone and relatively narrow toward the output end of the zone. Together, these two characteristics are effective in modifying the travel of the developer through the development zone in a manner to provide improved development efficiency. Preferably, the surface is roughened by producing deflection elements thereon which are diamond or waffle-shaped to partially convert tangential momentum of the falling developer to radial momentum while, the variable spacing is chosen to modulate the efficacy of the roughened surface as that tends to decrease tangential developer velocity so that the tangential velocity can rapidly attain a limiting value. Together, these permit attainment of the abovementioned goals.

Other objects, features and advantages of the present invention will become apparent upon perusal of the following detailed description taken in conjunction with the drawings.

DETAILED DESCRIPTION

Figure 1:
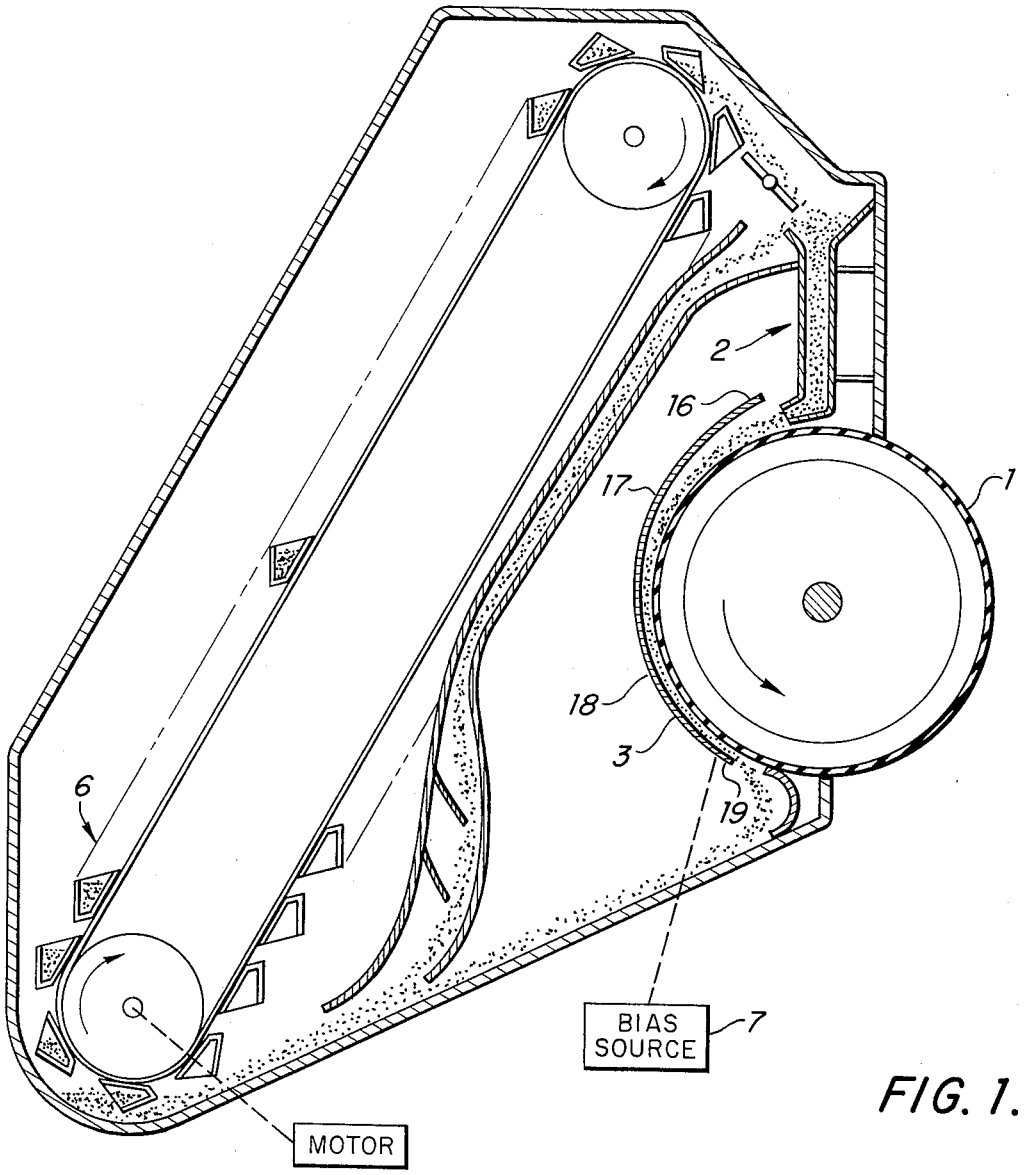
FIG. 1 schematically illustrates the development station of an electrophotographic copier.

In FIG. 1, a conventional xerographic drum 1 is illustrated together with developer feed chamber 2 and development plate 3. Other conventional portions of a xerographic machine such as the corona charging station, the exposure station and the drum cleaning station have not been shown in the interest of clarity. The developer is emitted from developer chamber 2 and cascades downwardly through the development zone formed between the surface of development plate 3 and the drum surface. The developer thereafter falls to the bottom of the machine as illustrated, and is thereafter transported by conveyor 6 to the top of the machine to be recirculated therethrough. The remaining portions of the developer transport system form no part of the present invention and thus will not be described.

It is greatly preferred, although not required, that development plate 3 (which is only schematically shown in FIG. 1) function as a metallic electrode which is electrically connected to a conventional bias source 7 as is well understood by those skilled in the art.

In order to obtain the above-described objects and goals with regard to increased development efficiency, the inside surface of the metallic electrode 3 is treated during the manufacturing process to produce a large plurality of tiny angled deflection elements which extend into the development zone and function to partially convert the tangential momentum of the falling developer to radial momentum relative to the drum.

Figure 2:
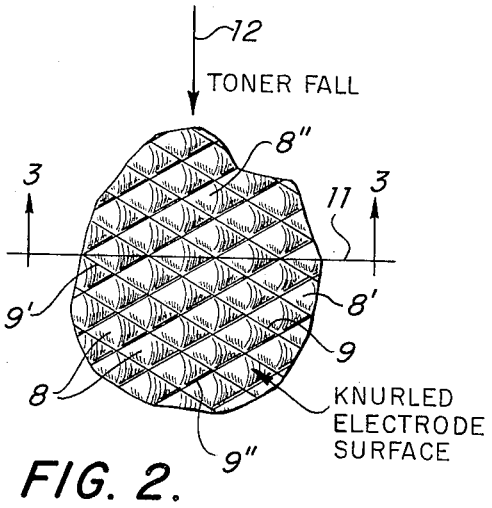
FIG. 2 illustrates a planar view of the roughened surface of the development electrode facing the drum according to one embodiment of the invention.
Figure 3:
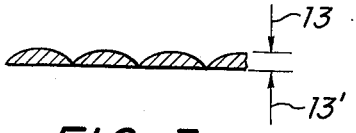
FIG. 3 illustrates a cross-section of a portion of the electrode of FIG. 2.
Figure 5:
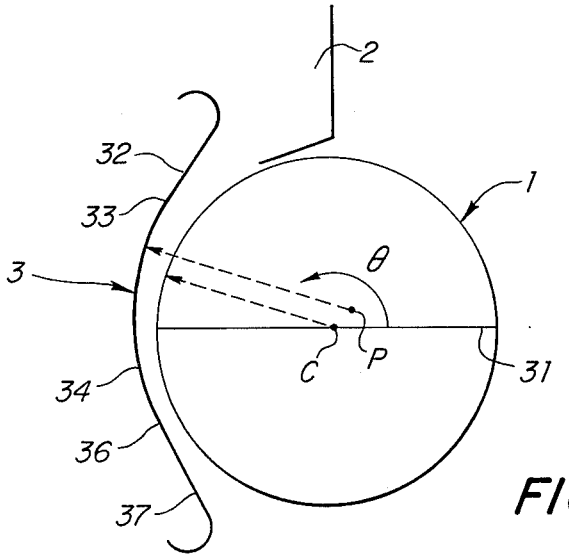

According to one embodiment, a surface morphology corresponding to a knurled surface was produced on a metallic plate which was formed as illustrated in FIG. 5. The resulting surface has a large plurality of diamond-shaped deflector elements formed by samll protuberances 8, 8′ and 8″ and by indentations 9, 9′, and 9″ as shown in FIG. 2. A cross-section indicated by cross-sectional line 11 is illustrated in FIG. 3 which shows one shape of the diamond deflector elements. Arrow 12 illustrates the direction of developer fall.

In the constructed machine the "roughness" or average height of the protuberances or deflector elements, namely the peak to valley distance between the arrows 13 and 13′ in FIG. 3 was about 9 mils for a carrier diameter of about 15 mils. The spatial frequency of the diamond pattern in the direction of developer fall was about 8.33 cycles per inch or, putting it another way, the spatial separation between corresponding portions in the pattern was about 120 mils. The spatial separation between corresponding portions in the pattern in the direction transverse to the developer fall was about 280 mils. The developer flow rate was approximately 41 grams per second for each inch of width of the development zone. A conventional developer having carrier and toner was employed, having a carrier diameter of about 15 mils.

As mentioned above, the scale of the surface roughness is carrier size dependent. It is preferred that the above-mentioned spatial separation in the direction of developer flow be within the range of 0.5 to 10 times the mean carrier diameter, and most preferably about 7 to 8 times the mean carrier diameter, and it is also preferred that the above-mentioned height of the deflector elements be within the range of 0.3 to 1.5 times the mean carrier diameter and most preferably about one-half the mean carrier diameter. Numerous variations in the shape of the deflector elements are believed to fall within the scope of the present invention although a diamond pattern is presently most preferred. As a general rule, the surface morphology is chosen to produce a large plurality of deflection elements or surfaces on the plate. Although these elements are formed as "protuberances" in the preferred embodiment, what is important is that the plate surface be designed to produce deflections of the falling developer radially toward the drum such that when employed in conjunction with other aspects of the invention, improved results will be attained, as will be amplified hereinafter.

Figure 4:
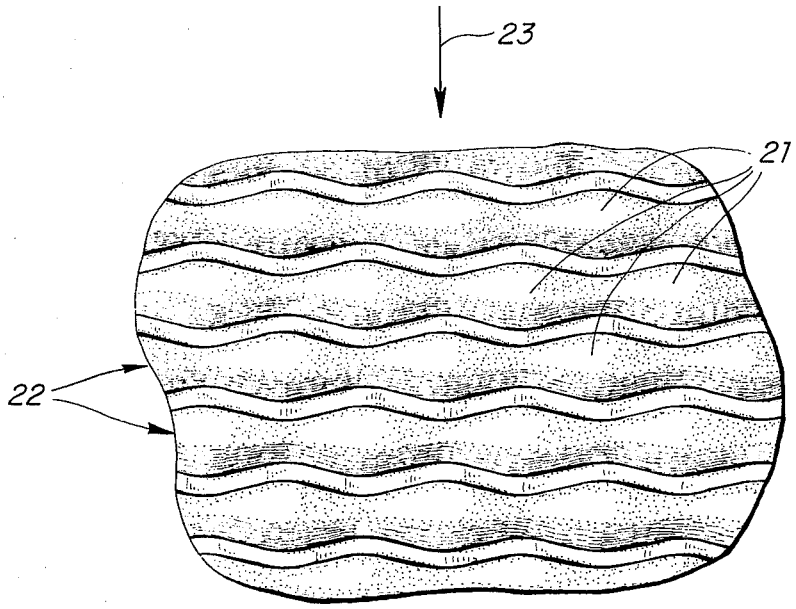
FIG. 4 illustrates a planar view of the roughened surface of the development electrode facing the drum according to a second embodiment of the invention; and, FIG. 5 is provided to illustrate the geometry of the presently most preferred embodiment.

In FIG. 4, an alternative embodiment of the present invention is illustrated wherein the surface of the electrode is provided with a diamond-shaped configuration somewhat different than that illustrated in FIG. 2. Specifically, in FIG. 4, the deflection elements 21 are also generally diamond-shaped, and are arranged in rows 22, however, they have a more rounded peripheral shape than FIG. 2. This surface configuration has been found to be effective in introducing a substantial radial motion to the falling developer (which normally travels in the direction indicated by arrow 23), while, at the same time, maintaining a generally streamlined flow of developer through the development zone without the creation of excessive turbulence which makes the overall development process less predictable. Excessive turbulence is to be avoided because it can cause the developer motion to be impeded to the extent that it ceases to flow properly. When this happens, the state of the developer in the zone becomes unstable and it can seize up in a close packed condition, resulting in unreliable operation. The area of instability is determined by many factors such as carrier diameter, toner concentration and type, etc., but appears to occur primarily with a carrier density in excess of about 50–60% dense packed.

The size of the deflection elements and their spacing are essentially the same for both the FIG. 2 and FIG. 4 embodiments.

As mentioned above, by covering the electrode plate with the specially designed deflection elements described, substantial radial movement of the falling developer toward the drum can be attained and this tends to make more toner available to the latent electrostatic image to develop it. Significantly improved results, however, are attained if, at the same time, the velocity of the falling developer tangential to the drum is reduced because this would increase the density of developer in the development zone, and, hence, the number of development events. In accordance with the present invention, the tangential velocity is allowed to rise rapidly in the beginning of the zone but is then limited to a relatively constant velocity throughout the remainder of the zone by varying the spacing (volume) between the electrode and the drum.

In particular, it has been determined that when the width of the development zone is varied from between a relatively wide spacing at the input end of the zone to a relatively narrow spacing toward the output end of the zone, the above desired effect can be attained. This variable spacing is illustrated roughly in FIG. 1 while in FIG. 5, the presently most preferred geometry between drum 1 and plate 3 is more clearly illustrated. In particular, FIG. 5 illustrates the preferred embodiment employing a xerographic drum 1 having a radius of 2.625 inches and an axis at C. Development plate 3 is also formed to have a circular portion of radius 2.744 inches having a center of curvature at point P which is displaced from axis C horizontally and vertically by 0.06 inches and 0.017 inches, respectively, as illustrated. This results in the development plate being eccentric relative to drum 1 to introduce the variable zone spacing. This curved portion of the plate extends from approximately point 33 which is at an angle of about 130° from horizontal line 31 as indicated by arrow $\theta$, to about an angle of 216° at point 36. From point 33 to point 32, which is at an angle of about 117°, the plate is flat and extends tangent to the curved portion from point 33. Similarly, the plate is flat from point 34 to point 37 (an angle of about 235°) and tangent to the curved portion from point 34.

With the above geometry, the development zone thus defined will have a width of about 180 mils at point 32, down to a width of about 56 mils at point 34 (about 200°), its narrowest point, and thereafter will begin to widen out again to about 200 mils at point 37.

In operation, when developer having a mean carrier diameter of about 15 mils is dispensed from chamber 2, it will accelerate rapidly in the zone because of the wide spacing at the top. As it continues to fall into the narrower portion of the zone, however, acceleration will substantially cease and, by the time it reaches narrowest point 34, the tangential velocity of the developer will become substantially constant and be slightly greater than the velocity of the drum surface itself (which will be about 10 inches/sec). At the same time, the effect of the deflection elements on plate 3 will become more significant because of the narrow spacing and increase the radial component of motion of the developer to direct increasing amounts of toner onto the latent image to develop it. As the developer passes through the zone beyond narrow most point 24, the zone will widen to permit free flow and avoid clogging.

It should be understood that the above spacings are meant to be exemplary of the preferred system only and could be varied in many respects without departing from the invention. In particular, the parameters described above are interdependent, and could be changed together within wide limits while retaining the same desired effects. The spacings given above are also measured from the tops of the deflector elements and these, themselves, may vary somewhat in height. The general rule is that the zone should vary smoothly and be generally wider at the beginning and narrower toward the end, and, the goal is to reduce the tangential velocity of the falling developer to make it approximately equal to or slightly greater than the velocity of the rotating drum surface at the narrowest point of the zone.

In summary, by providing a development electrode with a roughened surface while at the same time varying the width of the development zone between the drum and the electrode, significantly improved results are obtained. In general, the variable width of the zone causes the tangential velocity of the falling developer relative to the drum to be reduced while the roughened surface increases the radial velocity relative to the drum. Together, these features improve development efficiency, substantially eliminate directional effects, increase the scavenging ability of the developer, and, in general, make the development process more reliable and predictable.

While preferred embodiments of the invention have been described above, the teachings of this invention will readily suggest other embodiments. Accordingly, the invention should be limited only insofar as required by the scope of the following claims.

What is claimed is:

1. In a xerographic development station including: an imaging member having a surface for bearing an electrostatic image to be developed; a development plate having a surface spaced from said imaging member surface for defining a development zone therebetween; and means for introducing developer into said development zone to be cascaded therethrough along paths of travel adjacent said imaging member surface for developing said electrostatic image, the improvement comprising: wherein said development plate surface comprises a roughened surface for defining a large plurality of angled deflection elements thereon, said deflection elements covering at least a substantial portion of said development plate surface and being shaped to introduce a substantial component of motion to said developer in a direction transverse to said paths of travel thereof through said development zone for directing said cascading developer toward said imaging member surface for increasing development efficiency.

2. Apparatus as recited in claim 1 wherein said developer is in the form of carrier and toner and wherein said deflection elements have a spatial separation in the direction of said paths of travel of said developer of from about 0.5 to about 10 times the mean carrier diameter of said developer.

3. Apparatus as recited in claim 2 wherein said deflection elements have a spatial separation in the direction of said paths of travel of said developer of from about 7 to about 8 times the mean carrier diameter of said developer.

4. Apparatus as recited in claim 2 wherein said deflection elements comprise protuberances and wherein the height of said protuberances are from about 0.3 to about 1.5 times the mean carrier diameter of said developer.

5. Apparatus as recited in claim 2 wherein said deflection elements have a generally diamond-shaped configuration tapering away from said development plate surface.

6. Apparatus as recited in claim 5 wherein said generally diamond-shaped deflection elements have a generally rounded peripheral shape.

7. Apparatus as recited in claim 1 wherein said imaging member is cylindrical, said paths of travel of said developer are generally in tangential directions with respect to said imaging member surface, and wherein said deflection elements introduce a substantial component of motion to said developer in radial directions with respect to said imaging member for directing said developer toward said imaging member surface.

8. Apparatus as recited in claim 7 wherein said developer is in the form of carrier and toner and wherein said deflection elements have a spatial separation in the direction of said paths of travel of said developer of from about 0.5 to about 10 times the mean carrier diameter of said developer.

9. Apparatus as recited in claim 8 wherein said deflection elements have a spatial separation in the direction of said paths of travel of said developer of from about 7 to about 8 times the mean carrier diameter of said developer.

10. Apparatus as recited in claim 9 wherein said mean carrier diameter is about 15 mils and wherein said spatial separation is about 120 mils.

11. Apparatus as recited in claim 8 wherein said deflection elements comprise protuberances and wherein the height of said protuberances are from about 0.3 to about 1.5 times the mean carrier diameter of said developer.

12. Apparatus as recited in claim 11 wherein said mean carrier diameter is about 15 mils and wherein the height of said protuberances is about 9 mils.

13. Apparatus as recited in claim 8 wherein said deflection elements have a generally diamond-shaped configuration tapering away from said development plate surface.

14. Apparatus as recited in claim 13 wherein said generally diamond-shaped deflection elements have a generally rounded peripheral shape.

15. In a xerographic development station including: a cylindrical imaging member having a surface for bearing an electrostatic image to be developed; a development plate spaced from said imaging member for defining a development zone therebetween, said development zone having an input end and an output end; means for rotating said imaging member for moving said electrostatic image bearing surface through said development zone from said input end to said output end; and means for introducing developer into said development zone to be cascaded therethrough from said input end to said output end along paths of travel generally in a tangential direction with respect to said imaging member surface for developing said electrostatic image, the improvement comprising: wherein said development plate is spaced from said imaging member by a distance which generally decreases from said input end of said development zone toward said output end of said development zone, and wherein said development plate includes a development plate surface, said development plate surface being roughened over at least a substantial portion thereof for defining a large plurality of angled deflection elements thereon, the decreasing spacing of said development zone providing a reduction in the tangential velocity of said developer for increasing the density of the developer within said development zone, and said deflection elements providing an increase in the radial velocity of said developer with respect to said imaging member surface for directing said developer toward said imaging member surface.

16. Apparatus as recited in claim 15 wherein said developer is in the form of carrier and toner and wherein said deflection elements have a spatial separation in the direction of said paths of travel of said developer of from about 0.5 to about 10 times the mean carrier diameter of said developer.

17. Apparatus as recited in claim 15 wherein said deflection elements have a spatial separation in the direction of said paths of travel of said developer of from about 7 to about 8 times the mean carrier diameter of said developer.

18. Apparatus as set forth in claim 17 wherein said mean carrier diameter is about 15 mils and wherein said spatial separation in the direction of said paths of travel is about 120 mils.

19. Apparatus as recited in claim 18 wherein the spatial separation of said deflection elements in the direction perpendicular to said paths of travel is about 280 mils.

20. Apparatus as recited in claim 16 wherein said deflection elements comprise protuberances and wherein the height of said protuberances is from about 0.3 to about 1.5 times the mean carrier diameter of said developer.

21. Apparatus as recited in claim 20 wherein said mean carrier diameter is about 15 mils and wherein the height of said protuberances is about 9 mils.

22. Apparatus as recited in claim 16 wherein said deflection elements have a generally diamond-shaped configuration.

23. Apparatus as recited in claim 22 wherein said generally diamond-shaped deflection elements have a generally rounded peripheral shape.

* * * * *